United States Patent [19]

Hsieh

[11] Patent Number: 4,601,669

[45] Date of Patent: Jul. 22, 1986

[54] SOUNDING DEVICE FOR DOLLS

[76] Inventor: Chyi-Hun Hsieh, 3F, 2, Lane 21, Fwu-Yuan Street, Shin-Diann City, Taipeishiann, Taiwan

[21] Appl. No.: 690,767

[22] Filed: Jan. 11, 1985

[51] Int. Cl.[4] ..... A63H 3/28

[52] U.S. Cl. ..... 446/303

[58] Field of Search ..... 446/302, 303, 299, 298, 446/297, 353, 352, 340, 484

[56] References Cited

FOREIGN PATENT DOCUMENTS 2380045 9/1978 France ..... 446/303

2446658 8/1980 France ..... 446/298

*Primary Examiner*—Mickey Yu

*Attorney, Agent, or Firm*—Bucknam and Archer

[57] ABSTRACT

Sounding device for dolls consists of a sound producer provided in the upper body cavity of the doll actuated by a press-cam and restrict-cam both disposed on a cam shaft pivotable with the rotation of the doll's arm. The sound is being produced upon rotating of the arm to cause the pivoting of the cam shaft so that the press-cam actuates the switch contacts of the sounder.

3 Claims, 4 Drawing Figures

SOUNDING DEVICE FOR DOLLS

The present invention relates to a sounding device for dolls, particularly to a device that is suitable to be installed within the body of whatever kinds of dolls. A rhythmic sound is produced by pivoting of a cam device actuated by the rotation of the arm of doll.

In the conventional toy dolls, sound effect is usually achieved by installing within the doll's body a whistle which is compressible with a finger to produce a sound simulating the cry of a baby. The intermittent compress and release of the finger may maintain the sound but it is monotonous and tedious to work.

The present invention overcomes ineffectiveness of the conventional device and provide a new design by pivoting a cam means that is mounted on a cam shaft and movable with the rotation of the doll's arm. The cam presses a metal contacting switch to cause the sound to be produced by a sounder installed with the body cavity of the doll. To summarize, the sound is produced by a sounder preinstalled in the body of a doll and actuated by a cam means pivoting with the movement of the cam shaft rotatable with the movement of doll's arm.

Therefore the main object of the presant invention is to provide a sounding device comprising a preinstalled sounder actuated by a contact spring switch which is pressed by the pivoting of cam means mounted on a cam-shaft movable with the rotation of doll's arm.

Another object of the present invention is to provide a restrict cam which is also mounted on the same camshaft to give a limitation of the pivotable motion so as to prevent the first cam means from exerting too much pressure on the contact switch means.

A further object in the present invention is to provide a doll, of which inside its body frame, a sounder of whatever interest sounds may be installed by screwing therein, and on the rear part of the body frame an openable lid for changing the battery is provided to facilitate the replacement of a power cell such as a quartz cell.

Other features and objects of the present invention may become evident from the detailed description is taken in conjunction with the accompanying drawings, in which.

Figure 2:
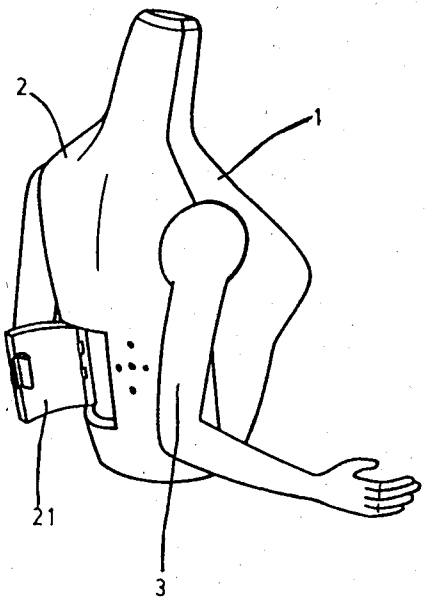
FIG. 2 is a perspective view showing the rear part of the body which an openable lid provided for the replacement of power cells.
Figure 1:
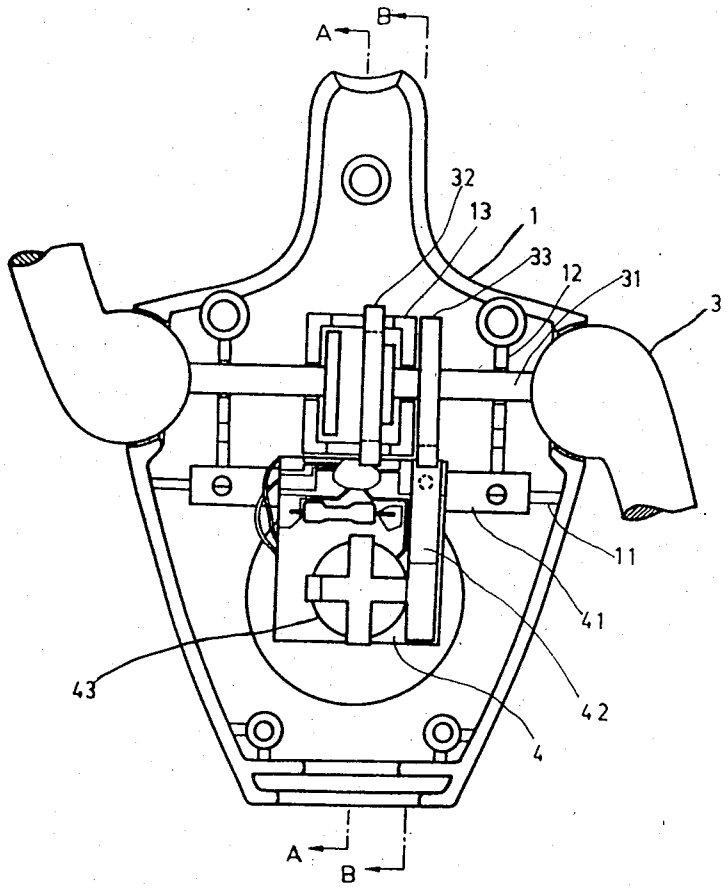
FIG. 1 is a view taken from rear of an upper part of front body frame denoting a preinstalled sounder screwed to the frame as well as cam means mounted on a camshaft linked to be pivoted with the rotation of the doll's arm.

Now referring to the annexed drawings, the sounding device for a doll of the present invention comprises a front part 1 of upper body frame of the doll, a rear part 2 and arms 3. Ribs 11, 12 and 13 in crosswise patterns are provided in the upper front body frame for the screw installation of a sound producer or sounder 4 and a restrict-cam 32, a press-cam 33 both mounted on a camshaft link 31 which is pivotable in unison with the rotation of the arm 3. The ribs also serve for the purpose of reinforcing the frame 1. Links 31 of both left and right arms are seated respectively on the notches disposed on the vertical ribs 12 and the cams 32 and 33 are supported on the square patterned ribs 13. The fixing holes on mounting wings 41 of the sounder 4 serve to be screwed on the intersection of ribs 11 and 12 by screws, the press-cam 33 with its cam surface contacting the press-spring piece 42 of a switch 44. The battery 43 such as a quartz cell may serve as the power source.

Again referring to FIG. 2: after installing the elements described hereinabove the front part 1, near part 2 of the upper body are adhered together. At the lower side of the rear part 2, an opening is provided with a lid 21, to facilitate the replacement of cell 43 in case of exhaustion.

The restrict-cam 32 on the camshaft 31, has radial drops 321 on its edges so as to be stopped on ribs 13 to prevent the press-cam 33 from pressing too much on the contact spring 42 of the switch, thus preventing damage to the sounder 4.

Figure 4:
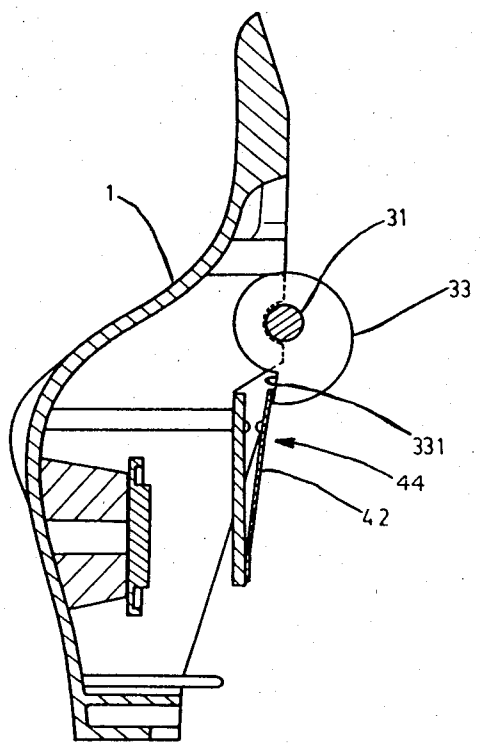
FIG. 4 is a sectional view taken along line B—B in FIG. 1, to show the actuation of the contact switch by the action of a press-cam.
Figure 3:
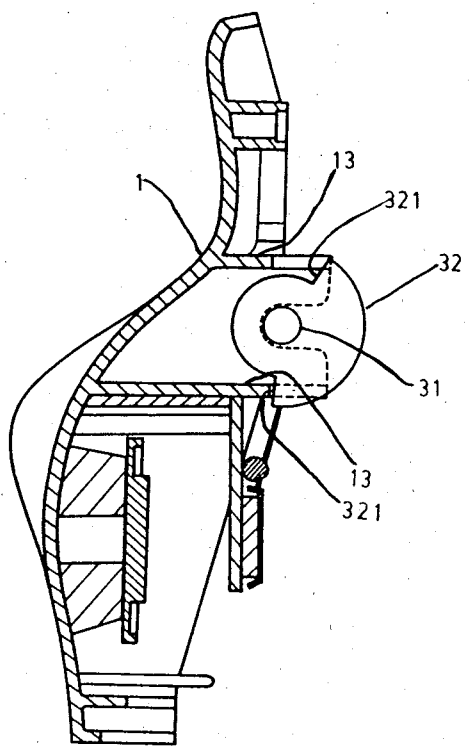
FIG. 3 is a sectional view taken along line A—A in FIG. 1, to show the action of a restrict-cam.

In FIG. 4, it can be seen that a radial drop 331 is also provided on the edge of the press-cam 33, which drop 331 presses on the upper part of the piece 42 to close the sounder's circuit so to produce the sound effect when the arm rotates.

The sounder 4 is of known type, shall not be detailed here.

Sound is produced through the rotary movement of the doll's arm which causes the pivotal movement of the camshaft, the press-cam inturn actuates the switch to produce the sound from the sounder while the restrict-cam serves to prevent too much pressure exerted by the press-cam so to protect the sounder from damage. The production of sound is achieved with the rotation of the arm, which is both novel and practical.

I claim:

1. A doll which comprises a body with two arms and a sounding device mountable in the interior of an upper part of the body of said doll and actuatable by the rotation of at least one arm of the doll, said sounding device comprises a first rib, a second rib and a third rib on a left side of the doll and a first rib, a second rib and a third rib on a right side of the doll positioned within the upper part of the body of the doll, each first rib being vertically positioned, each second rib being horizontally positioned and respectively intersecting each said first rib, the two third ribs forming a square pattern, one shaft positioned on each respective left and right side of the doll and connected to each respective arm of the doll and pivotable in response to manual rotation of the arm, each shaft being rotatably mounted on each respective first rib, press-camming means and restrict-camming means mounted on at least one of said shafts, a sound-making element mounted on the first and second ribs at their intersection point, said press-camming means upon rotation of the arm of the doll actuating said sound-making element, and said restrict-camming means being adpated to limit the motion of said press-camming means.

2. The doll according to claim 1 wherein said press-camming means is a first cam provided with a radial drop, said sound-making element having a switch, said radial drop pressing on said switch upon rotation of the arm.

3. The doll according to claim 2 wherein said restrict-camming means is a second cam provided with a radial drop, said radial drop contacting the third rib, whereby said second cam stops the rotation of said first cam.

* * * * *